US011732333B2

(12) United States Patent
Lorenzino

(10) Patent No.: US 11,732,333 B2
(45) Date of Patent: Aug. 22, 2023

(54) PROCESS FOR MANUFACTURING SHEET METAL MADE OF ALUMINUM-COPPER-LITHIUM ALLOY FOR MANUFACTURING AN AIRPLANE FUSELAGE

(71) Applicant: CONSTELLIUM ISSOIRE, Issoire (FR)

(72) Inventor: Pablo Lorenzino, Voiron (FR)

(73) Assignee: CONSTELLIUM ISSOIRE, Issoire (FR)

( * ) Notice: Subject to any disclaimer, the term of this patent is extended or adjusted under 35 U.S.C. 154(b) by 190 days.

(21) Appl. No.: 16/955,424

(22) PCT Filed: Dec. 17, 2018

(86) PCT No.: PCT/FR2018/053316
§ 371 (c)(1),
(2) Date: Jun. 18, 2020

(87) PCT Pub. No.: WO2019/122639
PCT Pub. Date: Jun. 27, 2019

(65) Prior Publication Data

US 2021/0071285 A1 Mar. 11, 2021

(30) Foreign Application Priority Data

Dec. 20, 2017 (FR) ..... 1762674

(51) Int. Cl.
*C22C 21/16* (2006.01)
*C21D 8/02* (2006.01)
*C22F 1/057* (2006.01)

(52) U.S. Cl.
CPC ..... *C22C 21/16* (2013.01); *C21D 8/0226* (2013.01); *C21D 8/0236* (2013.01); *C21D 8/0273* (2013.01); *C22F 1/057* (2013.01)

(58) Field of Classification Search
None
See application file for complete search history.

(56) References Cited

U.S. PATENT DOCUMENTS

2007/0181229 A1 8/2007 Bes et al.
2013/0092294 A1 4/2013 Eberl et al.
(Continued)

FOREIGN PATENT DOCUMENTS

EP 1966402 A1 9/2008
WO 2006/131627 A1 12/2006
(Continued)

OTHER PUBLICATIONS

PCT International Search Report for PCT/FR2018/053316, dated Apr. 8, 2019.
(Continued)

*Primary Examiner* — Brian D Walck
(74) *Attorney, Agent, or Firm* — McBee Moore & Vanik IP, LLC

(57) ABSTRACT

The subject of the invention is a process for manufacturing a wrought product made of aluminum alloy comprising the following steps: a) casting a plate made of alloy comprising, in percentages by weight, Cu: 2.1 to 2.8; Li: 1.1 to 1.7; Mg: 0.2 to 0.9; Mn: 0.2 to 0.6; Ti: 0.01-0.2; Ag<0.1; Zr<0.08; Fe and Si #0.1 each; unavoidable impurities #0.05% each and 0.15% in total; remainder aluminum; b) homogenizing said plate at 480-520° C. for 5 to 60 hours; c) hot-rolling and optionally cold-rolling said homogenized plate to give a sheet; d) solution annealing the sheet at 470-520° C. for 5 minutes to 4 hours; e) quenching the solution-annealed sheet; f) controlled tensioning of the solution-annealed and quenched sheet with a permanent set of 1 to 6%; g) tempering of the tensioned sheet by heating at a temperature of at least 160° C. for a maximum time of 30 hours.

16 Claims, 5 Drawing Sheets

(56) References Cited

U.S. PATENT DOCUMENTS

| | | | | |
|---|---|---|---|---|
| 2016/0368589 | A1* | 12/2016 | Bayona-Carrillo | ..... B64C 3/26 |
| 2019/0071753 | A1 | 3/2019 | Eberl et al. | |

FOREIGN PATENT DOCUMENTS

| | | | |
|---|---|---|---|
| WO | 2007/080267 | A1 | 7/2007 |
| WO | 2010/055225 | A1 | 5/2010 |
| WO | 2011/141647 | A2 | 11/2011 |
| WO | 2013/054013 | A1 | 4/2013 |
| WO | 2015/082779 | A2 | 6/2015 |

OTHER PUBLICATIONS

Kumar, et al., "Effect of a prior stretch on the aging response of an Al—Cu—Li—Ag—Mg—Zr alloy", Metallurgica, (1990), vol. 24, No. 7, p. 1245-1250.

Rioja, et al., "The Evolution of Al—Li Base Products for Aerospace and Space Applications", Metallurgical and Materials Transactions A, (2012), vol. 43, No. 9: 3325-3337.

* cited by examiner

PROCESS FOR MANUFACTURING SHEET METAL MADE OF ALUMINUM-COPPER-LITHIUM ALLOY FOR MANUFACTURING AN AIRPLANE FUSELAGE

CROSS-REFERENCE TO RELATED APPLICATIONS

This application is the National Stage entry of International Application No. PCT/FR2018/053316, filed 17 Dec. 2018, which claims priority to French Patent Application No. 1762674, filed 20 Dec. 2017.

BACKGROUND

Field of the Invention

The present invention relates in general to the processes for manufacturing sheet metal made of 2XXX alloy containing aluminum comprising lithium, in particular such improved processes particularly adapted to the constraints of the aeronautics and space industry. The processes according to the invention are especially suitable for the manufacturing of fuselage sheets.

Description of Related Art

A continuous research effort is carried out in the aeronautics industry and the space industry both in terms of composition of the alloys and in terms of manufacturing processes.

The Al—Cu—Li alloys are of particular interest for manufacturing rolled products made of aluminum alloy, in particular fuselage elements, since they offer generally higher property compromises than the conventional alloys, in particular in terms of compromise between fatigue, damage tolerance and mechanical strength. This allows in particular to reduce the thickness of the wrought products made from Al—Cu—Li alloy, thus maximizing even more the reduction in weight that they provide. Moreover, during the manufacturing of such products, it is important to take into account the constraints of the aeronautics industry in which any gain in time in the manufacturing of the semi-finished products constitutes a significant competitive advantage.

The document EP 1 966 402 B2 discloses in particular fuselage sheets with particularly advantageous properties, this sheet metal being created using an alloy comprising in particular, in weight percentage, Cu: 2.1 to 2.8; Li: 1.1 to 1.7; Ag: 0.1 to 0.8; Mg: 0.2 to 0.6; Mn: 0.2 to 0.6; Zr<0.04; Fe and Si≤0.1 each; inevitable impurities≤0.05 each and 0.15 in total; the rest aluminum. As described in detail in example 2 below, such a product cannot however be subjected to a manufacturing process optimized in terms of aging time without a deterioration of its properties, in particular of its compromise between mechanical strength and toughness.

The patent application WO2011/141647 describes an alloy containing aluminum comprising, in % by weight, 2.1 to 2.4% Cu, 1.3 to 1.6% Li, 0.1 to 0.51 Ag, 0.2 to 0.6% Mg, 0.05 to 0.15% Zr, 0.1 to 0.5% Mn, 0.01 to 0.12% Ti, optionally at least one element chosen from Cr, Se, and Hf, the quantity of the element, if it is chosen, being from 0.05 to 0.3% for Cr and for Se, 0.05 to 0.5% for Hf, a quantity of Fe and of Si less than or equal to 0.1 each, and inevitable impurities at a concentration less than or equal to 0.05 each and 0.15 in total. The alloy allows the creation of extruded, rolled and/or forged products particularly adapted to the manufacturing of elements of a lower surface of an airplane wing. In this document the temperature used for the aging in the examples is 155° C.

The patent application WO2013/054013 relates to the process for manufacturing a rolled product in particular for the aeronautics industry from aluminum alloy having a composition of 2.1 to 3.9% by weight of Cu, 0.7 to 2.0% by weight of Li, 0.1 to 1.0% by weight of Mg, 0 to 0.6% by weight of Ag, 0 to 1% by weight of Zn, at most 0.20% by weight of Fe+Si, at least one element chosen from Zr, Mn, Cr, Se, Hf and Ti, the quantity of said element, if it is chosen, being 0.05 to 0.18% by weight for Zr, 0.1 to 0.6% by weight for Mn, 0.05 to 0.3% by weight for Cr, 0.02 to 0.2% by weight for Se, 0.05 to 0.5% by weight for Hf and 0.01 to 0.15% by weight for Ti, the other elements at most 0.05% by weight each and 0.15% by weight in total, the rest aluminum, wherein in particular a levelling and/or a stretching with a cumulative deformation of at least 0.5% and less than 3%, and a short thermal treatment in which the sheet metal reaches a temperature between 130 and 170° C. for 0.1 to 13 hours are carried out. In this document the temperature used for the aging in the examples is 155° C.

The patent application WO2010/055225 relates to a process for manufacturing an extruded, rolled and/or forged product from aluminum alloy in which: a bath of liquid metal is created comprising 2.0 to 3.5% by weight of Cu, 1.4 to 1.8% by weight of Li, 0.1 to 0.5% by weight of Ag, 0.1 to 1.0% by weight of Mg, 0.05 to 0.18% by weight of Zr, 0.2 to 0.6% by weight of Mn and at least one element chosen from Cr, Sc, Hf and Ti, the quantity of the element, if it is chosen, being from 0.05 to 0.3% by weight for Cr and for Sc, 0.05 to 0.5% by weight for Hf and from 0.01 to 0.15% by weight for Ti, the rest being aluminum and inevitable impurities; an unwrought product is cast from the bath of liquid metal and said unwrought product is homogenized at a temperature between 515° C. and 525° C. in such a way that the equivalent time at 520° C. for the homogenization is between 5 and 20 hours. In this document the temperature used for the aging in the examples is between 145° C. and 155° C.

There is a need for products made of aluminum-copper-lithium alloy having an excellent compromise of properties, in particular in terms of antinomic properties such as the properties of static mechanical strength and those of toughness. Said products must also have good thermal stability, good resistance to corrosion, while being able to be obtained by a process that is simple, economical and capable of providing a significant competitive advantage.

SUMMARY

The object of the invention is a process for manufacturing a wrought product made of aluminum alloy comprising the following steps:

a. casting a rolling ingot made of alloy comprising, in percent by weight: Cu: 2.1 to 2.8; Li: 1.1 to 1.7; Mg: 0.2 to 0.9; Mn: 0.2 to 0.6; Ag<0.1; Zr<0.08; Ti 0.01 to 0.2; Fe and Si≤0.1 each; inevitable impurities≤0.05 each and 0.15 in total; the rest aluminum;
b. homogenizing said rolling ingot at 480-520° C. for 5 to 60 hours;
c. hot and optionally cold rolling said homogenized rolling ingot into sheet metal;
d. solution heat treatment of the sheet metal at 470-520° C. for 15 minutes to 4 hours;
e. quenching the solution heat treated sheet metal;

f. controlled stretching of the solution heat treated and quenched sheet metal with a permanent deformation of 1 to 6%;

g. aging of the stretched sheet metal by heating to a temperature of at least 160° C. for a maximum time of 30 hours.

Another object of the invention is a product capable of being obtained by the process according to the invention characterized in that among the phases containing lithium it does not contain the phase δ' but only the phase $T_1$.

DETAILED DESCRIPTION OF A PREFERRED EMBODIMENT

Figure 1:
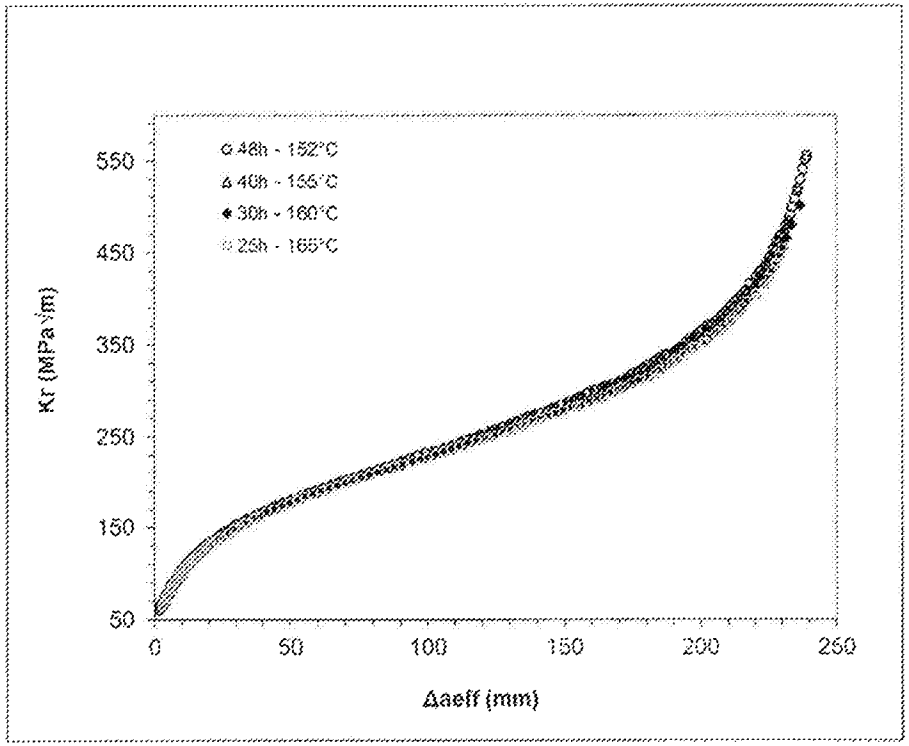
FIG. 1: R-curve in the direction T-L (CCT760 test piece) for sheet metal made of alloy A

Unless otherwise mentioned, all the indications relating to the chemical composition of the alloys are expressed as a percent by weight based on the total weight of the alloy. The expression 1.4 Cu means that the concentration of copper expressed in % by weight is multiplied by 1.4. The designation of the alloys is made in accordance with the regulations of The Aluminum Association, known to a person skilled in the art. The density depends on the composition and is determined by calculation rather than by a process for measuring weight. The values are calculated in accordance with the procedure of The Aluminum Association, which is described on pages 2-12 and 2-13 of "Aluminum Standards and Data". The definitions of the metallurgical states are indicated in the European standard EN 515 (1993).

The tensile static mechanical characteristics, in other words the ultimate tensile strength $R_m$, the conventional elastic limit at 0.2% elongation $R_{p0.2}$, and the elongation at rupture A %, are determined by a tensile test according to the standard NF EN ISO 6892-1/ASTM E8-E8M-13, the sampling and the direction of the test being defined by the standard EN 485-1.

A curve giving the effective stress intensity factor according to the effective crack extension, known as the R-curve, is determined according to the standard E561-10 (2010). The critical stress intensity factor $K_C$, in other words the intensity factor that makes the crack unstable, is calculated on the basis of the R-curve. The stress intensity factor $K_{CO}$ is also calculated by attributing the initial crack length at the beginning of the monotonic load to the critical load. These two values are calculated for a test piece having the required shape. $K_{app}$ represents the factor $K_{CO}$ corresponding to the test piece that was used to carry out the R-curve test. $K_{eff}$ represents the factor $K_C$ corresponding to the test piece that was used to carry out the R-curve test. $\Delta a_{eff(max)}$ represents the crack extension of the last valid point of the R-curve. The length of the R-curve—namely the maximum crack extension of the curve—is a parameter important in itself, in particular for fuselage design. Kr60 represents the effective stress intensity factor for an effective crack extension $\Delta a_{eff}$ of 60 mm.

Unless otherwise mentioned, the definitions of the standard EN 12258 (2012) apply.

Seeking to optimize even more the products capable of being used in the aeronautics industry in terms of both properties and manufacturing processes, the inventors have noted in a completely surprising manner that, contrary to the other alloys of the 2xxx family containing Li, it was possible to produce a product made of Al—Cu—Li alloy with optimized properties using a simple and particularly economical process. Thus, the process according to the invention comprises in particular a step of aging the stretched sheet metal by heating to a temperature of at least 160° C. for a maximum time of 30 hours. At the end of the process of the invention, the product having a particular composition has a toughness equal to or different by less than 8%, preferably less than 5%, even more preferably by less than 4% or even 2%, from that of the same product manufactured according to a conventional process of the prior art, in particular a process identical to that of the invention except for the aging which would typically be an aging by heating to approximately 152° C. for approximately 48 h. At the end of the process of the invention, the product having a particular composition advantageously has a conventional elastic limit Rp0.2 (TL) equal to or different by less than 8%, preferably less than 5%, even more preferably by less than 4% or even 2%, from that of the same product manufactured according to a conventional process of the prior art, in particular a process identical to that of the invention except for the aging which would typically be an aging by heating to approximately 152° C. for approximately 48 h.

The process for manufacturing a wrought product made of aluminum alloy according to the invention comprises first of all a step of casting a rolling ingot made of a particular alloy. Thus, the alloy comprises, in percent by weight, Cu: 2.1 to 2.8; Li: 1.1 to 1.7; Mg: 0.2 to 0.9; Mn: 0.2 to 0.6; Ti 0.01 to 0.2; Ag<0.1; Zr<0.08; Fe and Si≤0.1 each; inevitable impurities≤0.05 each and 0.15 in total; the rest aluminum.

In an advantageous embodiment, the rolling ingot made of aluminum alloy comprises from 2.2 to 2.6% by weight of Cu, preferably from 2.3 to 2.5% by weight. The inventors have discovered that if the concentration of copper is greater than 2.8% or even 2.6% or even 2.5% by weight, the toughness properties can in certain cases fall rapidly, whereas if the concentration of copper is less than 2.1% or even 2.2% or even 2.3% by weight, the mechanical strength can be too low.

The rolling ingot made of aluminum alloy comprises from 1.1 to 1.7% by weight of lithium. Preferably, it comprises from 1.2 to 1.6% by weight of Li, or even from 1.25 to 1.55% by weight. A concentration of lithium greater than 1.7% or even 1.6% or even 1.55% by weight can lead to problems of thermal stability. A concentration of lithium lower than 1.1% or even 1.2% or even 1.25% by weight can lead to an inadequate mechanical strength and a lower gain in terms of density.

The rolling ingot made of aluminum alloy comprises from 0.2 to 0.9% by weight of magnesium. According to an advantageous embodiment, the rolling ingot made of aluminum alloy comprises from 0.25 to 0.75% by weight of Mg.

The rolling ingot made of aluminum alloy comprises from 0.01 to 0.2% by weight of titanium. The addition of titanium in various forms, Ti, TiB or TiC allows in particular to control the grain structure during the cast rolling ingot.

According to an advantageous embodiment, the rolling ingot made of aluminum alloy comprises from 0.01 to 0.10% by weight of Ti.

The rolling ingot further comprises less than 0.1% by weight of silver. Advantageously, the rolling ingot made of aluminum alloy comprises less than 0.05% by weight of Ag, preferably less than 0.04% by weight.

The rolling ingot made of aluminum alloy comprises from 0.2 to 0.6% by weight of manganese. Preferably, it comprises from 0.25 to 0.45% by weight of Mn. The rolling ingot made of aluminum alloy comprises less than 0.08% by weight of zirconium. In an even more preferred embodiment, it comprises less than 0.05% by weight of Zr, preferably less than 0.04% by weight and, in an even more preferred manner, less than 0.03% or even 0.01% by weight. A low concentration of zirconium allows to improve the toughness of the Al—Cu—Li—Ag—Mg—Mn alloys according to the invention; in particular, the length of the R-curve is increased significantly. The use of manganese instead of zirconium in order to control the grain structure has several additional advantages such as obtaining a recrystallized structure and isotropic properties in particular for a thickness of 0.8 to 12.7 mm. Advantageously, the recrystallization rate of the products according to the invention is greater than 80%, preferably greater than 90%.

Iron and silicon generally affect the toughness properties. The quantity of iron must be limited to 0.1% by weight (preferably to 0.05% by weight) and the quantity of silicon must be limited to 0.1% by weight (preferably to 0.05% by weight).

The inevitable impurities must be limited to 0.05% by weight each and 0.15% by weight in total.

The manufacturing process according to the invention further comprises a step of homogenizing the as-cast rolling ingot at a temperature of 480 to 520° C. for 5 to 60 hours and, preferably, this step is carried out between 490 and 510° C. for 8 to 20 hours. The homogenization temperatures greater than 520° C. tend indeed to reduce the toughness performance in certain cases.

The homogenized rolling ingot is then hot and optionally cold rolled into sheet metal. In an advantageous embodiment, the hot rolling is carried out at an initial temperature of 420 to 490° C., preferably of 440 to 470° C. The hot rolling is preferably carried out to obtain a thickness between approximately 4 and 12.7 mm. For a thickness of approximately 4 mm or less, a step of cold rolling can be optionally added, if necessary. In the case of manufacturing sheet metal, the sheet metal obtained has a thickness between 0.8 and 12.7 mm, and the invention is more advantageous for sheet metal 1.6 to 9 mm thick, and even more advantageous for sheet metal 2 to 7 mm thick.

The rolled product is then solution heat treated, preferably by thermal treatment at a temperature of 470 to 520° C. for 15 min to 4 hours, then quenched typically with water at ambient temperature.

The solution heat treated product is then subjected to a step of controlled stretching with a permanent deformation of 1 to 6%. Preferably, the controlled stretching is carried out with a permanent deformation of between 2.5 and 5%.

Unexpectedly, the inventors discovered that the product made of alloy according to the invention can be manufactured using an optimized process, the aging step of said process being able to be carried out at particularly high temperatures, in particular greater than 160° C. and even more while the aging time can be, consequently, greatly reduced. In a completely surprising manner, this optimization of the process can be carried out without deterioration of the properties of the product, in particular without affecting the conventional elastic limit Rp0.2 (LT)-toughness Kapp (T-L) compromise.

Thus, the stretched product is subjected to a step of aging by a particular heating to a temperature of at least 160° C. for a maximum time of 30 hours. Preferably the aging can even be carried out at a temperature of at least 162° C., preferably of at least 165° C. and, even more preferably, of at least 170° C. for a maximum time of 30 hours, advantageously 28 hours or even 25 h or 20 h. Advantageously the aging step is carried out at a temperature of at most 200° C. and preferably of at most 190° C. and preferably of at most 180° C.

In a preferred embodiment, the aging is carried out at an equivalent time $t_i$ at 165° C. between 15 and 35 hours, preferably between 20 and 30 h. The equivalent time $t_i$ at 165° C. is defined by the formula:

$$t_i = \frac{\int \exp(-16400/T)dt}{\exp(-16400/T_{ref})}$$

where T (in Kelvin) is the instantaneous temperature of treatment of the metal, which changes with the time t (in hours), and $T_{ref}$ is a reference temperature set to 428K. $t_i$ is expressed in hours. The constant Q/R=16400K is derived from the activation energy for the diffusion of Cu, for which the value Q=136100 J/mol was used.

The present inventors observed that the products obtained by the process according to the invention do not contain, among the phases containing lithium, the phase δ' ($Al_3Li$) but only the phase $T_1$ ($Al_2CuLi$) which is advantageous in particular with regard to the thermal stability of the product obtained At the end of the process according to the invention, the product having a particular composition has a toughness Kapp (T-L) equal to or different by less than 8%, preferably less than 5%, even more preferably by less than 4 or even 2%, from that of the same product manufactured according to a conventional process of the prior art, in particular a process identical to that of the invention except for the aging which would typically be an aging by heating to approximately 152° C. for approximately 48 h. At the end of the process of the invention, the product having a particular composition also advantageously has a conventional elastic limit Rp0.2 (LT) equal to or different by less than 8%, preferably less than 5%, even more preferably by less than 4 or even 2%, from that of the same product manufactured according to a conventional process of the prior art, in particular a process identical to that of the invention except for the aging which would typically be an aging by heating to approximately 152° C. for approximately 48 h.

According to a preferred embodiment, the process according to the invention allows to obtain a product having at least one, advantageously at least two or even three or more of the following properties:

- conventional elastic limit, Rp0.2 (L), of at least 330 MPa, preferably at least 335 MPa and, even more preferably, at least 340 MPa;
- conventional elastic limit, Rp0.2 (LT), of at least 325 MPa, preferably at least 330 MPa and, even more preferably, at least 335 MPa;
- planar-stress toughness, Kapp (T-L), of at least 130 MPa √m; preferably at least 135 MPa √m and, even more preferably, at least 140 MPa √m;

effective stress intensity factor for an effective crack extension $\Delta a_{eff}$ of 60 mm, Kr60 (T-L), of at least 175 MPa √m, preferably at least 180 MPa √m and, even more preferably, at least 185 MPa √m.

Moreover, according to a preferred embodiment compatible with the previous embodiments, the process according to the invention allows to obtain a product having very good thermal stability. Thus, advantageously the product obtained directly at the end of the process according to the invention, that is to say at the end of the aging by heating to a temperature of at least 160° C. for a maximum time of 30 hours, and at the end of a thermal treatment of 1000 h at 85° C., has a planar-stress toughness, Kapp (T-L), and/or an effective stress intensity factor for an effective crack extension $\Delta a_{eff}$ of 60 mm, Kr60 (T-L), that does not differ by more than 7%, preferably more than 5% and, even more preferably, more than 4% or even 2%.

Advantageously the product according to the invention is sheet metal and more preferably a sheet, even more preferably a fuselage sheet. The product according to the invention can thus advantageously be used in a fuselage panel for an aircraft.

These aspects, as well as others of the invention, are explained in more detail using the following illustrative and non-limiting examples.

EXAMPLES

Example 1

The alloy A having the composition presented in table 1 is an alloy according to the invention.

TABLE 1

Chemical composition (% by weight)

| | Casting reference | | | | | | | | |
|---|---|---|---|---|---|---|---|---|---|
| | Si | Fe | Cu | Mn | Mg | Zr | Li | Ag | Ti |
| A | 0.01 | 0.03 | 2.3 | 0.3 | 0.3 | <0.01 | 1.4 | <0.01 | 0.03 |

SOES (spark optical emission spectrometry) analysis on solid. Average over three samples.

The process used for the manufacturing of the sheet metal made of alloy A was the following: a rolling ingot having a thickness of approximately 400 mm made of alloy A was cast, homogenized at 508° C. for approximately 12 hours then scalped. The rolling ingot was hot rolled to obtain sheet metal having a thickness of 4 mm. It was solution heat treated at approximately 500° C. then quenched with cold water. The sheet metal was then stretched with a permanent elongation of 3 to 4%. The following agings were carried out on various samples of the sheet metal: 48 h-152° C., 40 h-155° C., 30 h-160° C. and 25 h-165° C.

For each of the aging conditions, some of the sheet metal was subjected to a thermal stability test of 1000 h at 85° C.

The toughness of the sheet metal was characterized by R-curve tests according to the standard ASTM E561-10 (2010). The tests were carried out with a full-thickness CCT test piece (W=760 mm, 2a0=253 mm). All of the results are reported in table 2 and illustrated by FIG. 1.

TABLE 2

Summary data of the R-curve

| Aging conditions | Kr (MPa√m) at $\Delta a_{eff}$ (mm) | | | | | | | |
|---|---|---|---|---|---|---|---|---|
| | 10 | 20 | 30 | 40 | 50 | 60 | 70 | 80 |
| 48 h at 152° C. | 104.4 | 133.3 | 152.9 | 166.4 | 179.2 | 190.9 | 201.9 | 212.3 |
| 40 h at 155° C. | 116.7 | 141.2 | 157.5 | 172.7 | 183.7 | 192.5 | 203.3 | 212.2 |
| 30 h at 160° C. | 102.1 | 131.7 | 152.4 | 166.7 | 179.9 | 191.6 | 199.6 | 209.7 |
| 25 h at 165° C. | 101.8 | 130.5 | 149.2 | 164.9 | 177.0 | 188.9 | 199.3 | 209.4 |
| 48 h at 152° C. + 1000 h at 85° C. | 104.7 | 133.9 | 153.6 | 167.3 | 181.1 | 192.8 | 202.0 | 212.3 |
| 40 h at 155° C. + 1000 h at 85° C. | 100.4 | 132.7 | 153.2 | 167.9 | 181.3 | 193.2 | 203.3 | 213.1 |
| 30 h at 160° C. + 1000 h at 85° C. | 98.5 | 134.0 | 154.6 | 170.5 | 183.3 | 194.1 | 204.4 | 215.4 |
| 25 h at 165° C. + 1000 h at 85° C. | 108.2 | 134.6 | 153.1 | 168.2 | 180.7 | 191.5 | 201.3 | 210.9 |

Figure 2:
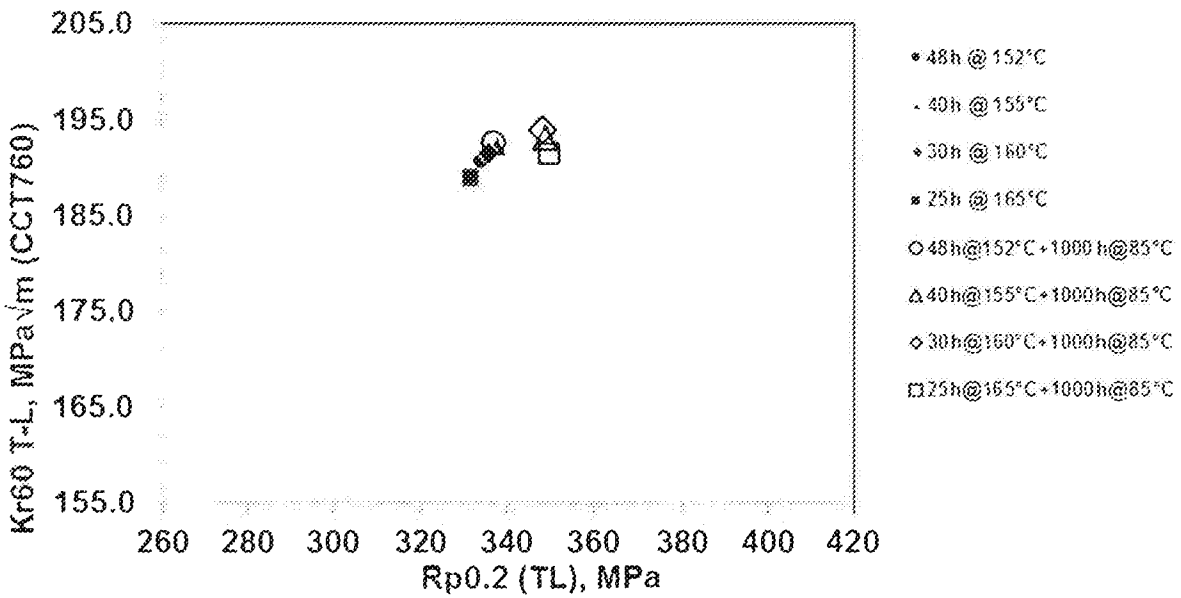
FIG. 2: Toughness $K_{r60}$ (T-L) according to the elastic limit $R_{p0.2}$ (TL) for sheet metal made of alloy A

Samples were taken at full thickness to measure the tensile static mechanical characteristics and the toughness in the direction T-L. The test pieces used for the measurement of toughness were test pieces having the geometry CCT760: 760 mm (L)×1250 mm (TL). The results are reported in table 3 and illustrated by FIG. 2. FIG. 2 shows the preservation of a good compromise between the elastic limit and the toughness, in particular the preservation of excellent toughness regardless of the aging conditions.

TABLE 3

Mechanical properties and toughness tests

| Aging conditions | Rp0.2 (LT) in MPa | Rm (LT) in MPa | A % (L) | Kapp (T − L) in MPa√m |
|---|---|---|---|---|
| 48 h at 152° C. | 334 | 393 | 12.9 | 145.0 |
| 40 h at 155° C. | 338 | 395 | 13.0 | 144.7 |
| 30 h at 160° C. | 337 | 394 | 13.0 | 143.0 |
| 25 h at 165° C. | 343 | 397 | 12.6 | 142.9 |
| 48 h at 152° C. + 1000 h at 85° C. | 337 | 394 | 12.3 | 144.7 |
| 40 h at 155° C. + 1000 h at 85° C. | 349 | 406 | 13.1 | 145.4 |
| 30 h at 160° C. + 1000 h at 85° C. | 348 | 403 | 12.7 | 146.9 |
| 25 h at 165° C. + 1000 h at 85° C. | 350 | 404 | 12.0 | 144.0 |

Example 2

The alloy B having the composition presented in table 4 is a reference alloy in particular known from the document EP 1 966 402 B2.

TABLE 4

Chemical composition (% by weight)

| | Casting reference | | | | | | | | |
|---|---|---|---|---|---|---|---|---|---|
| | Si | Fe | Cu | Mn | Mg | Zr | Li | Ag | Ti |
| B | 0.03 | 0.03 | 2.4 | 0.3 | 0.3 | <0.01 | 1.4 | 0.34 | 0.02 |

SOES (spark optical emission spectrometry) analysis on solid. Average over three samples.

The process used for the manufacturing of the sheet metal made of alloy B was the following: a rolling ingot having a thickness of approximately 400 mm made of alloy B was cast, homogenized at 500° C. for approximately 12 hours then scalped. The rolling ingot was hot rolled to obtain sheet metal having a thickness of 5 mm. It was solution heat treated at approximately 500° C. then quenched with cold water. The sheet metal was then stretched with a permanent elongation of 1 to 5%. The following agings were carried out on various samples of the sheet metal: 48 h-152° C. and 25 h-165° C.

Figure 3:
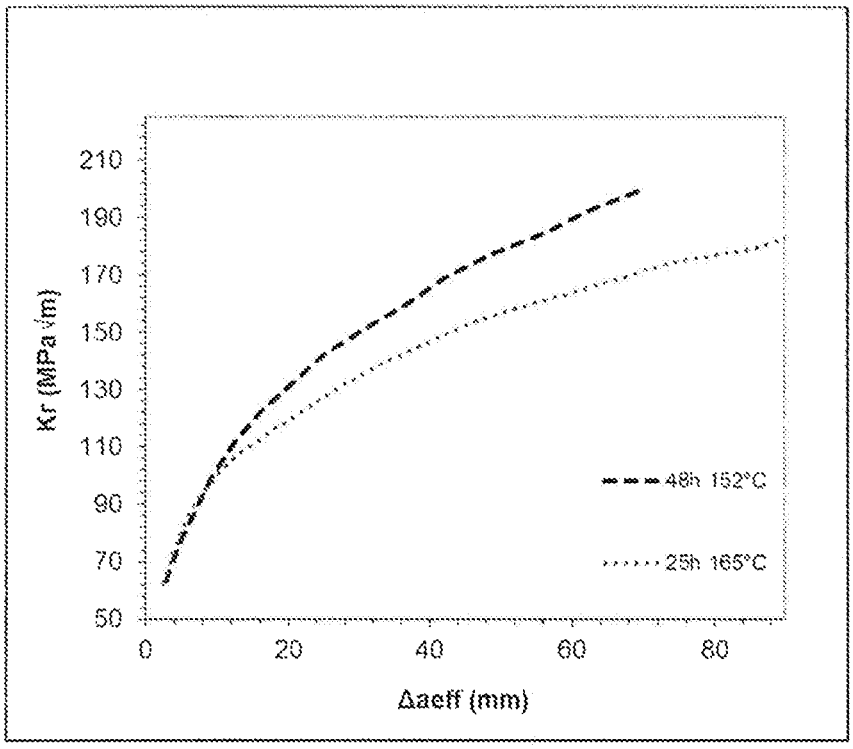
FIG. 3: R-curve in the direction T-L (CCT760 test piece) for sheet metal made of alloy B

The toughness of the sheet metal was characterized by R-curve tests according to the standard ASTM E561-10 (2010). The tests were carried out with a full-thickness CCT test piece (W=760 mm, 2a0=253 mm). All of the results are reported in table 5 and illustrated by FIG. 3.

TABLE 5

Summary data of the R-curve

| Aging | Kr (MPa√m) at $\Delta a_{eff}$ (mm) | | | | | | | |
|---|---|---|---|---|---|---|---|---|
| conditions | 10 | 20 | 30 | 40 | 50 | 60 | 70 | 80 |
| 48 h at 152° C. | 101 | 130 | 150 | 166 | 179 | 190 | 200 | 209 |
| 25 h at 165° C. | 99 | 119 | 135 | 147 | 157 | 164 | 171 | 177 |

Samples were taken at full thickness to measure the tensile static mechanical characteristics and the toughness in the direction T-L. The test pieces used for the measurement of toughness were test pieces having the geometry CCT760: 760 mm (L)×1250 mm (TL).

The results are reported in table 6.

TABLE 6

Mechanical properties and toughness tests

| Aging conditions | Rp0.2 (LT) in MPa | Rm (LT) in MPa | A % (L) | Kapp (T − L) in MPa√m |
|---|---|---|---|---|
| 48 h at 152° C. | 343 | 411 | 11.2 | 142 |
| 25 h at 165° C. | 367 | 428 | 10.3 | 123 |
| 48 h at 152° C. + 1000 h at 85° C. | 377 | 457 | 10.7 | 122 |

Example 3

The effects of high-temperature aging have also been studied in the literature. This example repeats the data presented in the articles cited below highlighting the known impact of high-temperature aging such as that of the invention on the toughness for aluminum alloys comprising in particular copper and lithium:

Effects of aging treatment on strength and fracture toughness of 2A97 aluminum-lithium alloy, S. Zhong et al., The Chinese Journal of Nonferrous Metals, Vol 21, n3, 2011

The effect of ageing temperature on the fracture toughness of an 8090 Al—Li alloy, K. J. Duncan and J. W. Martin, Journal of Materials Science Letters, Vol 10, Issue 18, pp 1098-1100, 1991

Figure 4:
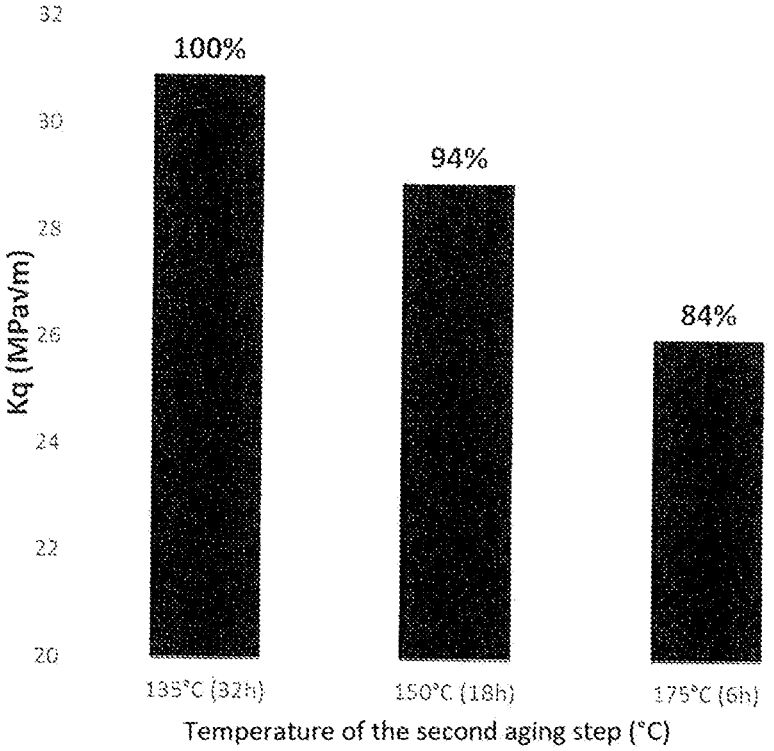
FIG. 4: Toughness Kq according to the temperature of the second aging step during aging in two steps applied to a product made of 2A97 alloy (according to Zhong et al., 2011)

The article by Zhong et al. is relative to the Al—Cu—Li alloy 2A97. It brings to light the reduction in toughness induced by the increase in temperature of the second aging step during two-step aging on a product made of 2A97 alloy. FIG. 4 presents the following aging conditions:

16 h at 135° C.+32 h at 135° C.;

16 h at 135° C.+18 h at 150° C. (reduction in toughness of 6% with respect to 16 h at 135° C.+32 h at 135° C. two-plateau aging);

16 h at 135° C.+6 h at 175° C. (reduction in toughness of 16% with respect to 16 h at 135° C.+32 h at 135° C. two-plateau aging).

Figure 5:
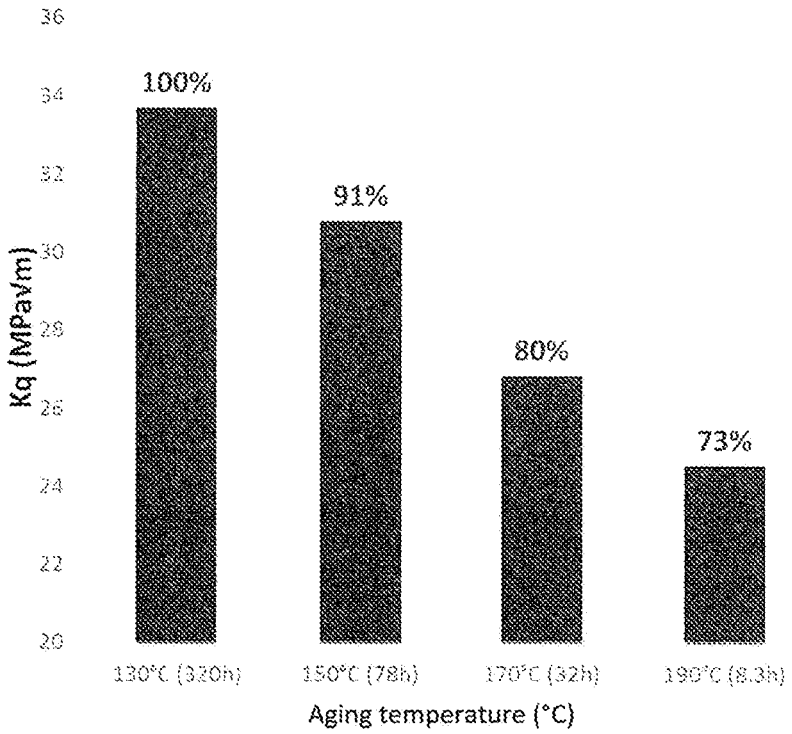
FIG. 5: Toughness Kq according to the aging temperature applied to a product made of 8090 alloy (according to Duncan and Martin, 1991)

The article by Duncan and Martin relates to the Al—Li alloy 8090. The goal of this article was to study the variation in the toughness with an increase in the aging temperature in a material having a constant hardness (similar static properties). A reduction in toughness induced by the increase in aging temperature on a product made of 8090 alloy for the same aging state (same hardness) was thus brought to light. FIG. 5 presents the following aging conditions:

320 h at 130° C.;

78 h at 150° C. (reduction in toughness of 9% with respect to aging of 320 h at 130° C.);

32 h at 170° C. (reduction in toughness of 20% with respect to aging of 320 h at 130° C.);

8.3 h at 190° C. (reduction in toughness of 27% with respect to aging of 320 h at 130° C.).

Example 4

Transmission electron microscopy examinations were carried out on products according to the invention and reference products. A rolling ingot made of alloy A was transformed according to process described in example 1. A rolling ingot made of alloy B was transformed according to the process of example 2. 4 agings were carried out: 150 h at 130° C. (R1) or 120 h at 140° C. (R2) or 48 hours at 152° C. (R3) or 20 h at 175° C. (R4). For the alloy A the agings R1, R2 and R4 were carried out. For the alloy B the aging R3 was carried out. The products obtained were observed by transmission electron microscopy. The samples were prepared by double-jet electrochemical thinning (30% HNO3+ Methanol, 20V, −30° C.). The transmission electron microscope LEO EM912 OMEGA 120 kV equipped with an energy filter for electron energy-loss spectroscopy (EELS), with an SIS image analysis system and with an EDX (LINK OXFORD) analysis system was used. The images were acquired by the Slow Scan CCD camera (high-quality digital images via the large dynamic range and the response linearity), by the SIT camera ("large-field" images at TV speed), or on sheet film (to record the diffraction diagrams). The acceleration voltage was 120 kV.

For the product obtained with the alloy A with the aging according to the invention R4, a precipitate of the type phase δ' ($Al_3Li$) is not observed, but only the phase $T_1$ ($Al_2CuLi$). For the agings R1 and R2 outside of the invention, the diffraction figure corresponding to the phase δ' is observed. For the aging R3 carried out with the alloy B the phase δ' is also observed in a lesser quantity.

The invention claimed is:

1. A product obtained by a method comprising, a. casting a rolling ingot made of an alloy comprising:

2.1 to 2.8% by weight of Cu;

1.1 to 1.7% by weight of Li;

0.2 to 0.9% by weight of Mg;

0.2 to 0.6% by weight of Mn;

0.01 to 0.2% by weight of Ti;

less than 0.1% by weight of Ag;

less than 0.08% by weight of Zr;

a quantity of Fe and of Si less than or equal to 0.1% by weight each, and inevitable impurities at a concentration less than or equal to 0.05% by weight each and 0.15% by weight in total;

the rest aluminum;

b. homogenizing said rolling ingot at 480-520° C. for 5 to 60 hours;

c. hot and optionally cold rolling said homogenized rolling ingot into sheet metal;

d. solution heat treatment of the sheet metal at 470-520° C. for 15 minutes to 4 hours;

e. quenching the solution heat treated sheet metal;

f. controlled stretching of the solution heat treated and quenched sheet metal with a permanent deformation of 1 to 6%;

g. aging of the stretched sheet metal by heating to a temperature of at least 170° C., for a maximum time of 30 hours, wherein among phases containing lithium said phases do not contain the phase δ' but only phase $T_1$, wherein g of aging is carried out at an equivalent time $t_i$ at 165° C. between 20 and 30 hours, the equivalent time $t_i$ at 165° C. being defined by formula:

$$t_i = \frac{\int \exp(-16400/T)dt}{\exp(-16400/T_{ref})}$$

wherein T (in Kelvin) is the instantaneous temperature of treatment of the metal, which changes with the time t (in hours), and $T_{ref}$ is a reference temperature set to 438K.

2. The product according to claim 1, wherein the rolling ingot made of aluminum alloy comprises from 2.2 to 2.6% by weight of Cu.

3. The product according to claim 1, wherein the rolling ingot made of aluminum alloy comprises from 1.2 to 1.6% by weight of Li.

4. The product according claim 1, wherein the rolling ingot made of aluminum alloy comprises from 0.25 to 0.75% by weight of Mg.

5. The product according to claim 1, wherein the rolling ingot made of aluminum alloy comprises from 0.25 to 0.45% by weight of Mn.

6. The product according to claim 1, wherein the rolling ingot made of aluminum alloy comprises less than 0.05% by weight of Ag.

7. The product according to claim 1, wherein the rolling ingot made of aluminum alloy comprises less than 0.05% by weight of Zr.

8. The product according to claim 1, wherein the hot rolling is carried out at an initial temperature of 420 to 490° C.

9. The product according to claim 1, wherein the controlled stretching of the sheet metal is carried out with a permanent deformation of between 2.5 and 5%.

10. The product according to claim 1 having at least one of the following properties:

conventional elastic limit, Rp0.2 (L), of at least 330 MPa;

conventional elastic limit, Rp0.2 (LT), of at least 325 MPa;

planar-stress toughness, Kapp (T-L), of at least 130 MPa √m;

effective stress intensity factor for an effective crack extension $\Delta a_{eff}$ of 60 mm, Kr60 (T-L), of at least 175 MPa √m.

11. The product according to claim 1 wherein at the end of a thermal treatment of 1000 h at 85° C., said product has a planar-stress toughness, Kapp (T-L), and/or an effective stress intensity factor for an effective crack extension $\Delta a_{eff}$ of 60 mm, Kr60 (T-L), that does not differ by more than 7%.

12. The product according to claim 10, wherein the product has three or more of the properties.

13. The product according to claim 10 wherein:

the conventional elastic limit, Rp0.2 (L) is at least 335 MPa;

the conventional elastic limit, Rp0.2 (LT) is at least 330 MPa;

the planar-stress toughness, Kapp (T-L) is at least 135 MPa √m;

the effective stress intensity factor for an effective crack extension $\Delta a_{eff}$ of 60 min, Kr60 (T-L), is at least 180 MPa √m.

14. The product according to claim 10 wherein:

the conventional elastic limit, Rp0.2 (L) is at least 340 MPa;

the conventional elastic limit, Rp0.2 (LT) is at least 335 MPa;

the planar-stress toughness, Kapp (T-L) is at least 140 MPa √m;

the effective stress intensity factor for an effective crack extension $\Delta a_{eff}$ of 60 mm, Kr60 (T-L), is at least 185 MPa √m.

15. The product according to claim 1 wherein at the end of a thermal treatment of 1000 h at 85° C., said product has a planar-stress toughness, Kapp (T-L), and/or an effective stress intensity factor for an effective crack extension $\Delta a_{eff}$ of 60 mm, Kr60 (T-L), that does not differ by more than 5%.

16. The product according to claim 1 wherein at the end of a thermal treatment of 1000 h at 85° C., said product has a planar-stress toughness, Kapp (T-L), and/or an effective stress intensity factor for an effective crack extension $\Delta a_{eff}$ of 60 mm, Kr60 (T-L), that does not differ by more than 2%.

* * * * *